US009896640B2

(12) United States Patent
Stammer et al.

(10) Patent No.: US 9,896,640 B2
(45) Date of Patent: Feb. 20, 2018

(54) METHOD OF REDUCING FRICTION AND WEAR BETWEEN SURFACES UNDER A HIGH LOAD CONDITION

(71) Applicants: Dow Corning Corporation, Midland, MI (US); Northwestern University, Evanston, IL (US)

(72) Inventors: Andreas Stammer, Pont-a-Celles (BE); Manfred Jungk, Geisenheim (DE); Herbert Stoegbauer, Huenfelden (DE); Yip-Wah Chung, Wilmette, IL (US); Tobin J. Marks, Evanston, IL (US); Qian Jane Wang, Mt. Prospect, IL (US); Thomas J. Zolper, Cuba City, WI (US)

(73) Assignees: DOW CORNING CORPORATION, Midland, MI (US); NORTHWESTERN UNIVERSITY, Evanston, IL (US)

( * ) Notice: Subject to any disclaimer, the term of this patent is extended or adjusted under 35 U.S.C. 154(b) by 0 days.

(21) Appl. No.: 14/647,498

(22) PCT Filed: Nov. 27, 2013

(86) PCT No.: PCT/US2013/072127
§ 371 (c)(1),
(2) Date: May 27, 2015

(87) PCT Pub. No.: WO2014/085520
PCT Pub. Date: Jun. 5, 2014

(65) Prior Publication Data
US 2015/0315514 A1 Nov. 5, 2015

Related U.S. Application Data

(60) Provisional application No. 61/730,831, filed on Nov. 28, 2012.

(51) Int. Cl.
*C10M 107/50* (2006.01)
*C10M 169/04* (2006.01)

(52) U.S. Cl.
CPC ..... *C10M 169/042* (2013.01); *C10M 107/50* (2013.01); *C10M 2229/0415* (2013.01);
(Continued)

(58) Field of Classification Search
CPC ..... C10M 107/50; C10M 2229/003; C10M 2229/0405; C10M 2229/0415; C10M 2229/0425
(Continued)

(56) References Cited

U.S. PATENT DOCUMENTS 3,019,249 A 1/1962 Gunderloy, Jr.
3,211,652 A 10/1965 Hinkamp
(Continued)

FOREIGN PATENT DOCUMENTS

JP S63256693 A 10/1988
JP 2005320486 A 11/2005
WO WO8707638 A2 12/1987

OTHER PUBLICATIONS

Thomas Zolper et al: "Lubrication Properties of Polyalphaolefin and Polysiloxane Lubricants: Molecular Structure-Tribology Relationships," Tribology Letters, Kluwer Academic Publishers—Plenum Publishers, NE, vol. 48, No. 3, Aug. 24, 2012 (Aug. 24, 2012), pp. 355-365, XP035126047, ISSN: 1573-2711, DOI: 10.1007/S11249-012-0030-9 abstract; figure 1.
(Continued)

*Primary Examiner* — Ellen McAvoy
(74) *Attorney, Agent, or Firm* — Warner Norcross & Judd LLP

(57) ABSTRACT

A method of using lubricant compositions to reduce wear between two surfaces exposed to a load condition of at least
(Continued)

1 GPa is provided. The lubricant compositions comprise polysiloxane base oils having alkylaryl or a combination of alkyl and aryl functionality. The polysiloxane base oils may be defined according to the formula:

wherein R, R', and R" are independently selected, such that R is an alkyl group having between 1-3 carbon atoms; R' is an alkylaryl group comprising alkyl functionality with 3-12 carbon atoms and aryl functionality with 6 to 12 carbon atoms; R" is an alkyl group having between 1-3 carbon atoms or an alkylaryl group comprising alkyl functionality with 3-12 carbon atoms and aryl functionality with 6 to 12 carbon atoms; and m and n are integers, such that 8<(m+n)<500.

19 Claims, 6 Drawing Sheets

(52) U.S. Cl.
CPC ..... *C10M 2229/0425* (2013.01); *C10N 2220/021* (2013.01); *C10N 2220/033* (2013.01); *C10N 2230/06* (2013.01); *C10N 2230/54* (2013.01); *C10N 2230/58* (2013.01); *C10N 2240/02* (2013.01); *C10N 2240/04* (2013.01); *C10N 2240/046* (2013.01); *C10N 2240/10* (2013.01)

(58) Field of Classification Search
USPC ..... 508/208–215
See application file for complete search history.

(56) References Cited

U.S. PATENT DOCUMENTS 4,097,393 A 6/1978 Cupper et al.
4,164,473 A 8/1979 Coupland et al.
4,190,546 A * 2/1980 Kulik ..... C10M 171/002 508/208
4,244,831 A 1/1981 Cupper
4,259,254 A 3/1981 Bridger
4,449,415 A * 5/1984 Groenhof ..... C10M 107/50 476/7
4,755,311 A 7/1988 Burjes et al.
4,792,410 A 12/1988 Schwind et al.
4,889,647 A 12/1989 Rowan et al.
5,073,278 A 12/1991 Schumacher et al.
5,110,488 A 5/1992 Tipton et al.
5,137,647 A 8/1992 Karol
5,268,113 A 12/1993 Evans
5,273,669 A 12/1993 Schumacher et al.
5,480,573 A * 1/1996 Durfee ..... C10M 171/001 252/572
5,523,005 A 6/1996 Di Biase et al.
5,656,577 A * 8/1997 Kato ..... C10M 169/04 252/78.1
5,736,251 A * 4/1998 Pinchuk ..... A61L 27/34 427/387
6,235,686 B1 5/2001 Karol et al.
6,245,725 B1 6/2001 Tanaka et al.
6,348,437 B1 * 2/2002 Avery ..... C08L 83/04 252/77
6,451,863 B1 * 9/2002 Ebbrecht ..... B01D 19/04 106/31.25
6,602,830 B1 * 8/2003 Fey ..... C10M 169/00 252/78.3
6,623,399 B2 * 9/2003 Fey ..... C08G 77/04 192/21.5
6,642,187 B1 11/2003 Schwind et al.
6,962,895 B2 11/2005 Scharf et al.
7,399,734 B2 7/2008 Grabowski et al.
7,439,211 B2 * 10/2008 Guichard ..... B29C 33/64 106/38.22
7,553,429 B2 * 6/2009 Forbus ..... C09K 5/10 252/73
7,745,560 B2 * 6/2010 Schutz ..... C09G 3/00 508/110
8,071,514 B2 * 12/2011 Han ..... C07F 7/0852 508/202
8,642,520 B2 * 2/2014 Aguilar ..... C10M 169/04 508/207
8,796,190 B2 * 8/2014 Kato ..... H01L 23/3737 508/150
2007/0057226 A1 3/2007 Forbus
2009/0227481 A1 9/2009 Han et al.
2012/0004151 A1 1/2012 Aguilar et al.
2015/0232782 A1 * 8/2015 Fisher ..... C10M 169/042 508/208

OTHER PUBLICATIONS

Thomas J. Zolper et al: "Friction and Wear Protection Performance of Synthetic Siloxane Lubricants," Tribology Letters, vol. 51, No. 3, Jun. 8, 2013 (Jun. 8, 2013), pp. 365-376, XP55107227, ISSN: 1023-8883, DOI: 10.1007/s11249-013-0169-z figures 1, 3-9.
European Patent Office, Rijswijk, Netherlands, International Search Report of International Application No. PCT/US2013/072127, mailed Mar. 24, 2014, 3 pages.
English language abstract and machine translation for JPS63256693 (A) extracted from http://worldwide.espacenet.com database on May 30, 2017, 8 pages.
English language abstract and machine translation for JP2005320486 (A) extracted from http://worldwide.espacenet.com database on May 30, 2017, 18 pages.
International Search Report for PCT/US2013/072127, dated Mar. 24, 2014, 4 pages.

* cited by examiner

METHOD OF REDUCING FRICTION AND WEAR BETWEEN SURFACES UNDER A HIGH LOAD CONDITION

CROSS REFERENCE TO RELATED APPLICATIONS

This application is the National Stage of International Application Serial No. PCT/US2013/072127 filed on Nov. 27, 2013, designating the United States and published in English, which claims the benefit of the filing date under 35 U.S.C. § 119(e) of U.S. Provisional Application No. 61/730,831 filed Nov. 28, 2012, the entire contents of each of which are hereby incorporated herein by reference.

This disclosure relates generally to the use of lubricant compositions to reduce the friction and wear between two surfaces that are placed under a high load condition. More specifically, this disclosure relates to the use of lubricant compositions comprising polysiloxane base oils with alkylaryl or a combination of alkyl and aryl functionality.

The statements in this section merely provide background information related to the present disclosure and may not constitute prior art.

A variety of lubricant compositions ranging from natural and petroleum-derived hydrocarbons (mineral oils), to synthetic hydrocarbon-based and silicone-based polymers are currently available. The development of synthetic lubricants in recent decades has been the result of concerted efforts to optimize the rheological and tribological properties of the lubricants for use in diverse applications. A multitude of silicon based polymers known as silanes (—Si—), silalkylenes (—Si—C—), silazanes (—Si—N—) and siloxanes (—Si—O—) have been developed for use in elastomers, coatings, surface modifiers, photoresist separation membranes, and soft contact lenses. Siloxanes, which are generally derived from silica (e.g., sand), have undergone the most extensive evaluation due to their commercial significance.

Siloxanes are polymeric structures that have silicon-oxygen backbones instead of carbon-carbon backbones as are typically found in hydrocarbons. The strength of the Si—O bond (~460 kJ/mol) exceeds that of the C—C bond (~348 kJ/mol). In addition, siloxane molecules are more flexible than the corresponding hydrocarbons because they exhibit less steric hindrance relative to chain rotation around the backbone structure. This low steric hindrance is attributed to factors including the longer Si—O bond (0.164 nm, cf. 0.153 nm for C—C), the oxygen atoms not being encumbered by side groups, and the greater Si—O—Si bond angle (about 143°, cf. about 110° for C—C—C). The enhanced flexibility of siloxanes allows for increased compactness, lower melting temperatures, and lower glass transition temperatures. In general, siloxanes are known to have exceptional oxidative stability, low bulk viscosity (and temperature-viscosity coefficient), water-repellency, biological inertness, and relatively low surface tension that allows them to be spread more evenly on a surface than conventional hydrocarbons.

Siloxanes are generally derived from reacting silicon with methyl chloride to produce dimethyldichlorosilanes, which are then mixed with water to produce silanols, followed by polymerization. One example of a conventional siloxane polymer is polydimethylsiloxane (PDMS). PDMS is composed of a backbone chain of alternating silicon and oxygen atoms with methyl groups bonded to the silicon atoms. PDMS is known to provide poor boundary lubrication properties. However, the replacement of methyl groups with other groups, such as phenyl groups, can lead to a reduction in boundary friction and wear. Such a replacement will also lead to an increase in the molecular rigidity of siloxane polymer when used in sufficient quantity. For example, polyphenylmethylsiloxane (PPMS), which has phenyl groups in place of a substantial number of methyl groups exhibits both increased wear resistance and oxidative stability, but also a decrease in molecular flexibility.

BRIEF SUMMARY OF THE INVENTION

The present disclosure generally provides for the use of a lubricant composition to reduce the wear between two surfaces placed under a load condition resulting in a Hertzian pressure in excess of 1 GPa, alternatively the two surfaces are metal surfaces. The lubricant composition comprises a polysiloxane base oil corresponding to the structural formula:

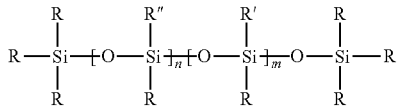

wherein R, R', and R" are independently selected, such that R is an alkyl group having between 1-3 carbon atoms; R' is an alkylaryl group comprising alkyl functionality with 3-12 carbon atoms and aryl functionality with 6 to 12 carbon atoms; R" is an alkyl group having between 1-3 carbon atoms or an alkylaryl group comprising alkyl functionality with 3-12 carbon atoms and aryl functionality with 6 to 12 carbon atoms; and m and n are integers, such that $8<(m+n)<500$. Alternatively, the integer m and n in the structure of the polysiloxane base oil are selected such that the sum of (m+n) is greater than 8 and less than 250. Alternatively, the ratio of the integer m to the sum of the integers (m+n) in the polysiloxane base oil is between 0.1 and 1.00.

According to one aspect of the present disclosure, the R in the polysiloxane base oil is a methyl group, the R' is an alkylphenyl group with the alkyl functionality having between 5-8 carbon atoms; and the R" is a methyl group or an alkylphenyl group with the alkyl functionality having between 2-5 carbon atoms. Alternatively, the R in the polysiloxane is a methyl group, the R' is a hexylphenyl group, and R" is a methyl group or a propylphenyl group.

According to another aspect of the present disclosure, the polysiloxane base oil corresponds to the structural formula:

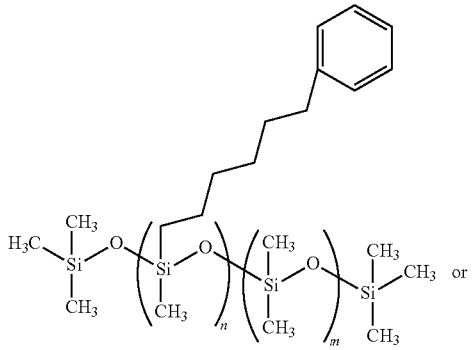

-continued

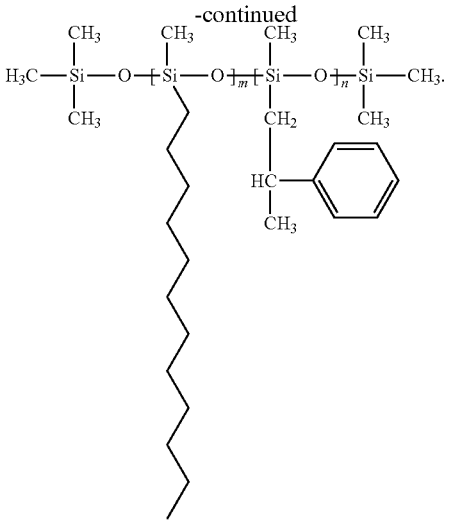

The polysiloxane base oil has a molecular mass between 1,500 g/mol and 35,000 g/mol and exhibits a viscosity at zero shear and 303 K that is between 50 and 5,000 mPa·s (centipoise). When desirable, the lubricant composition may further comprise at least one functional additive selected as one from the group of extreme pressure additives, anti-wear additives, antioxidants, antifoams, and corrosion inhibitors.

According to another aspect of the present disclosure, the two surfaces, between which the lubricant composition is placed, represents an elastohydrodynamic lubrication (EHL) contact point in a machine element. Alternatively, the machine element may be a rolling element bearing, a sliding bearing, a gear, a cam and a cam follower, or a traction drive.

The lubricant composition provides an EHL film thickness on the surface between 10 and 2,000 nm and a coefficient of friction that is less than about 0.07 at a temperature of 303 K and an entrainment speed between about 0.05 and 5.00 m/s. Alternatively, the lubricant composition provides an EHL film thickness on the surface between 10 and 1,000 nm and a coefficient of friction that is less than about 0.05 at a temperature of 398 K and an entrainment speed between about 0.05 and 5.00 m/s.

A method of reducing wear between rolling or sliding surfaces in a machine element is also provided in which the method comprises the steps of providing a machine element having a first surface and a second surface; providing a lubricant composition between the first surface and second surface, and allowing the first surface to roll or slide past the second surface under a load condition in excess of 1 GPa. In this method, the first and second surfaces represent an elastohydrodynamic lubrication (EHL) contact point in the machine element. The machine element and the lubricant composition comprise the surfaces and polysiloxane base oil placed there between as previously described above and further described hereafter.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

Figure 1:
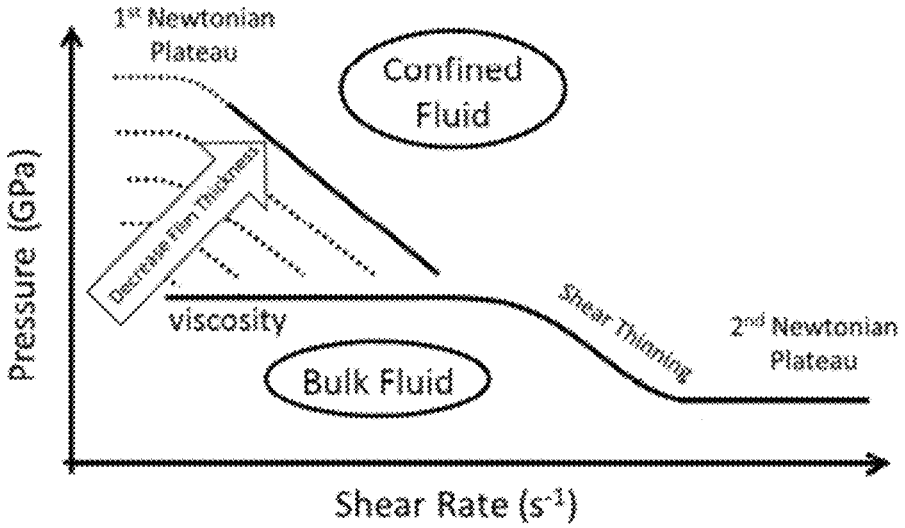
FIG. 1 is a graphical depiction of the shear thinning behavior for lubricant compositions.

The following description is merely exemplary in nature and is in no way intended to limit the present disclosure or its application or uses. It should be understood that throughout the description, corresponding reference numerals indicate like or corresponding parts and features.

The present disclosure generally relates to lubricant compositions that exhibit both wear resistance and oxidative stability, while maintaining molecular flexibility. The lubricant compositions made and used according to the teachings contained herein are described throughout the present disclosure in conjunction with various test configurations that are appropriate for measuring wear properties, such as a four-ball wear test (American Standard Test Method, D-5183, ASTM International, West Conshohocken, Pa.), an SRV wear test (American Standard Test Method, D 5706-05, ASTM International, West Conshohocken, Pa.), and a thin film ball on disk wear test defined herein in order to more fully illustrate the concept. The incorporation and use of these lubricant compositions in conjunction with other types of sliding or rolling contacts, such as those found in various machine elements, including but not limited to, rolling element bearings, gears, cams and cam followers, or traction drives, is contemplated to be within the scope of the disclosure.

Alkyl groups, such as hexyl, octyl, and dodecyl groups can be grafted onto the backbone or chain structure of polysiloxanes to improve their lubricating properties. Polyalkylmethylsiloxanes (PAMS) have alkyl groups of varying length attached to the silicon atoms of the polymeric backbone. The use of such alkyl groups can improve the boundary friction, hydrodynamic friction and wear resistance of the siloxane polymers when incorporated in a high percentage. A similar effect is observed for the incorporation of aryl groups. However, an increase in elastohydrodynamic (EHD) friction is observed to occur for highly branched PPMS, while shear thinning behavior may occur in highly branched PAMS that have high molecular mass. These divergent trends, although both beneficial in their own right, are combined upon the synthesis of compound branch configurations, such as those shown in structures S(I) and S(II) below. The compound branch configuration may incorporate both aryl functionality and alkyl chain functionality attached to different silicon atoms in the polysiloxane backbone as shown in structure S(I) or use an aryl group (e.g., phenyl group, among others) attached to the siloxane backbone by an alkyl chain (e.g., hexyl group, among others) as shown in structure S(II). Alkyl-aryl branched siloxanes, such as those shown in structures, S(I) and SOD, offer the dual benefit of exhibiting resistance to permanent shear thinning, while also being subject to temporary shear thinning along with its energy saving benefits.

S(I)

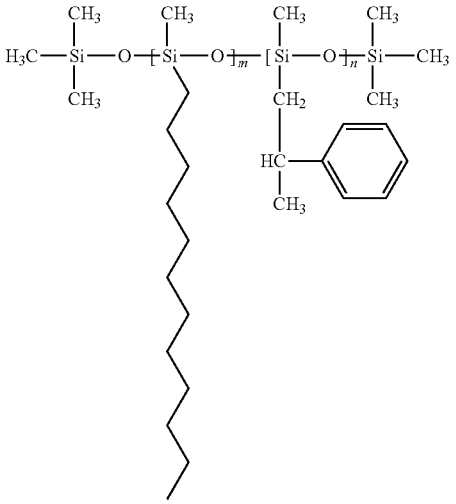

S(II)

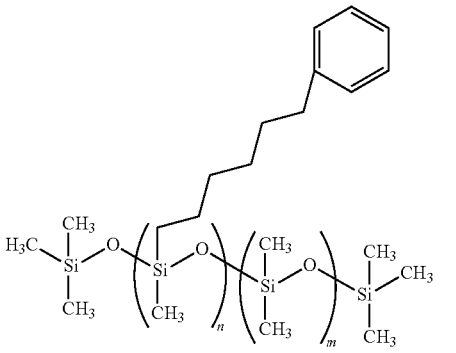

According to one aspect of the present disclosure, the lubricant composition prepared and used according to the teachings of the present disclosure includes a polysiloxane base oil having a structure described by structure S(III). In structure S(III), R, R', and R" are independently selected to comprise linear or branched alkyl functionality, alternatively, linear alkyl functionality, such that R is an alkyl group having between 1-3 carbon atoms; R' is an alkylaryl group comprising alkyl functionality with 3-12 carbon atoms and aryl functionality with 6 to 12 carbon atoms; R" is an alkyl group having between 1-3 carbon atoms or an alkylaryl group comprising alkyl functionality with 3-12 carbon atoms and aryl functionality with 6 to 12 carbon atoms; and m and n are integers, such that 8<(m+n)<500; alternatively 8<(m+n)<250. Optionally, the R, R', or R" may also include the substitution of a hydrogen atom with a functional ligand, such as a halogen atom, e.g., fluorine, an amino group, or a carboxyl group, among others.

S(III)

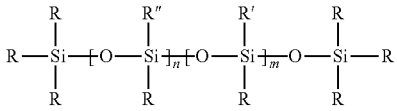

According to another aspect of the present disclosure, the ratio of the integer m to the sum of the integers (m+n) in the polysiloxane base oil shown in Structure S(III) is between 0.1 and 1.00. One example of a polysiloxane base oil according to Structure S(III) may be described, such that R is a methyl group, R' is an alkylphenyl group with the alkyl functionality having between 5-8 carbon atoms; and R" is a methyl group or an alkylphenyl group with the alkyl functionality having between 2-5 carbon atoms. Alternatively, R is a methyl group, R' is a hexylphenyl group, and R" is a methyl group or a propylphenyl group. Alternatively, the polysiloxane base oil is defined according to structures S(I) or S(II).

One skilled in the art will understand that although Structure S(III) is shown to include only M units ($R_3SiO_{1/2}$) and D units ($R'RSiO_{2/2}$ or $R''RSiO_{2/2}$), such structure may also comprise T units ($R'''SiO_{3/2}$) or Q units ($SiO_{4/2}$) as branch points resulting in the crosslinking of polysiloxane backbones or chains without exceeding the scope of the present disclosure. The R" group associated with any T unit that is present in the polysiloxane base oil may be independently selected and defined similarly as to the descriptions provided for the R, R', or R" groups above. The number of T units or Q units present in the polysiloxane base oil may be predetermined according to the viscosity and lubrication properties desired for the lubricant when used in a specific application.

According to another aspect of the present disclosure, the polysiloxane base oil has a molecular mass that is between about 1,500 g/mol and about 35,000 g/mol; alternatively, between about 2,500 g/mol and 25,000 g/mol. The viscosity of the polysiloxane base oils may range at zero shear and 303K between 50 mPa·s (centipoise) and 5,000 mPa·s (centipoise); alternatively, between 50 mPa·s and about 3,500 mPa·s; alternatively, between about 250 mPa·s and 5,000 mPa·s.

The lubricant composition of the present disclosure is used to reduce the wear between two surfaces that are placed under a load condition in excess of about 1 GPa. Alternatively, the two surfaces are "hard" surfaces, wherein the term "hard" refers to a surface that will not deform when exposed to a load of 1.0 GPa or more. Alternatively, the load condition is at least 1.5 GPa; alternatively the load condition is greater than about 2.0 GPa; alternatively, the load condition is between about 1.0 and 4.0 GPa. Several specific examples of "hard" surfaces include, but are not limited to, ceramic surfaces and metal surfaces. Conventional plastic and rubber surfaces undergo either temporary deformation, permanent deformation, or both under the load conditions to which the surfaces are subjected in the present disclosure.

The film forming ability of the polysiloxane base oils is represented by a film thickness model that includes parameters, such as atmospheric viscosity, entrainment velocity (U), and pressure-viscosity index ($\alpha$). This model, as shown in Equation 1 is a simplification of the Hamrock-Dowson film thickness equations by condensing the interface parameters into a constant (k).

$$h_{oil}=kU^{0.67}\eta_0^{0.67}\alpha^{0.53} \quad \text{Eq. (1)}$$

According to another aspect of the present disclosure, the viscosity at atmospheric pressure ($\eta_0$) describes the rheological properties of the lubricant, but since viscosity is a strong function of temperature, pressure, and interfacial shear; it can vary significantly at the tribological interface. The viscosity of the polysiloxane base oils increase with the polymer length, branch content, branch length, and effective molecular mass. The lubricant compositions of the present disclosure may undergo temporary shear thinning when exposed to the high shear rate encountered at the tribological interface. Conventionally, non-Newtonian fluids are either described as being shear-thinning or shear-thickening. Some lubricants exhibit non-Newtonian properties, e.g., shear thinning, especially at high molecular masses and strain rates. The viscosity of non-Newtonian fluids depends on shear rate and molecular mass in addition to conditions such as temperature and pressure. Temporary shear thinning occurs when the lubricant molecules align in the direction of motion in a tribological interface. The alignment of the lubricant molecules creates a pathway that reduces the resistance to successive molecules that move through the interface. Evidence for shear thinning can be established theoretically by kinetic theory and experimentally by flow birefringence. Additional support for the role of molecular alignment in shear thinning can be obtained from molecular dynamics simulations. Temporary shear thinning fluids do not suffer permanent viscosity breakdown, but if the shear thinning behavior is too strong, then it can lead to film failure and increased boundary friction due to wear.

Temporary shear thinning occurs when the fluid strain rate reaches a critical value where the time for the lubricant molecules to transit through the interface is less than the molecular relaxation time, whereby, the Brownian motion returns aligned molecules to a random position. The molecular relaxation time ($\lambda$) is often approximated by the Einstein-Debye relation ($\lambda_{EB}$) which is approximately equal to the Rouse equation ($\lambda_{Rouse}$) as shown in Equation 2. Relaxation time increases with increasing molecular mass (M) and decreases as temperature increases (T). Additional factors that influence relaxation time include the density ($\rho$), viscosity ($\eta$) and ideal gas constant ($R_g$). The relaxation time is originally derived to describe the time for molecules to return to random orientations after being aligned by an electric field.

$$\lambda_{EB}=\frac{\eta M}{\rho R_g T}\approx\lambda_{Rouse}=\frac{12\eta M}{\pi^2\rho R_g T} \quad \text{Eq. (2)}$$

Shear thinning fluids typically exhibit a constant viscosity, known as the "1st Newtonian Plateau" ($\eta_1$), up to a critical strain rate ($\dot{\gamma}_{cr}$) as shown in FIG. 1. When the reciprocal of the critical strain rate exceeds the molecular relaxation time, the fluid becomes shear thinning and has a variable shear viscosity ($\eta_s$) that decreases with increasing strain rate. Some fluids also have a "2nd Newtonian Plateau" ($\eta_2$), however it is not always present or detectable.

Figure 2:
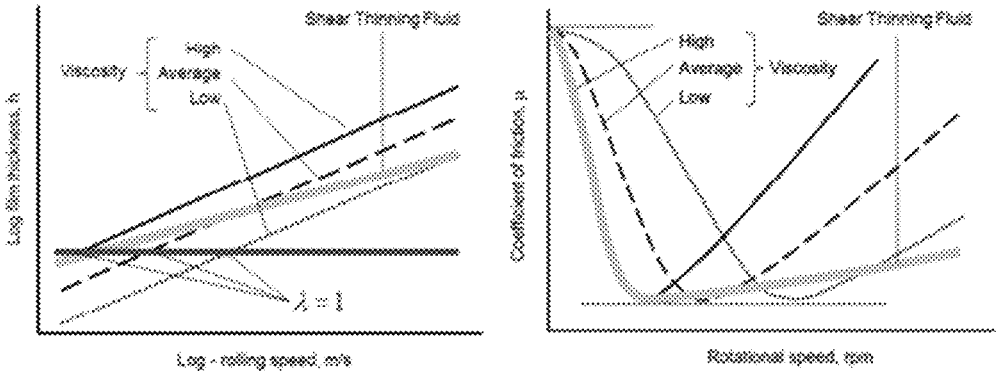
FIG. 2 is a graphical depiction of the effects of shear thinning on film formation and friction coefficient.

Molecular relaxation time increases significantly in confined spaces and may exceed theoretical values for individual molecules by collective motion Shear thinning in polydimethylsiloxane, PDMS ($M_w$=10,000-80,000 g/mol) and other polymers begin to occur at lower shear rates when such fluids are under high pressure. A universal shear thinning model that fully describes this phenomenon is shown in FIG. 2.

The film thickness of a fluid that is undergoing shear thinning is less than that of a Newtonian fluid, so a correction must be made to the predicted film thickness. This correction includes a correction factor ($\phi$) that uses the velocity, viscosity, Newtonian film thickness ($h_N$) and the shear modulus (G) to calculate shear thinning behavior according to Equation 3. This correction factor has been used to successfully predict the film thickness of shear thinning polyalphaolefins (PAO) and PDMS.

$$\phi=\frac{h_N}{h_{NN}}=\left[1+4.44\left(\frac{U\eta_0}{h_N G}\right)^{1.69}\right]^{1.26(1-n)^{1.78}} \quad \text{Eq. (3)}$$

The exponent (n) in Equation 3 is the logarithmic slope of the shear stress in relation to the shear rate, an indicator of the extent and severity of shear thinning behavior for a given fluid as described in Equation 4. It is measured by a shear viscometer.

$$n=\frac{\partial\log\tau}{\partial\log\dot{\gamma}} \quad \text{Eq. (4)}$$

Typically, shear thinning begins at lower strain rates in fluids under high pressure. Since polymers of different compositions may take on similar shear thinning characteristics at high pressures, the phenomenon can be described by an universal model as shown in FIG. 2. Using the film thickness correction factor ($\phi$), the film thickness and hydrodynamic friction coefficient can be calculated, as well as significant reductions in viscous friction can be projected for the use of shear thinning lubricants in a gear box. In fact, substantial energy savings may be achievable when a shear thinning lubricant is used in a gear box.

The viscosity and shear behavior exhibited by different siloxane lubricants can be influenced by varying the percent branching (Q), alkyl branch length (L), pendant branch type (J), and overall polymer length (Z) in the molecular structure. In the present disclosure, the percentage of phenylalkylmethyl D units in poly(phenylalkylmethyl dimethyl)siloxanes (PPAMS) can range from about 30% to about 100%. Thus PPAMS as used herein also describes poly(phenylalkylmethyl)siloxane when the phenylalkylmethyl D units in the polymer are at about 100%.

Permanent viscosity breakdown known as 'molecular scission' is generally undesirable and occurs when the polymers of a lubricant are mechanically broken down into shorter-lower mass segments. The damage is permanent and the viscosity loss is not recoverable. Industrial lubricants are often required to pass a series of stringent shear tests to determine their permanent shear stability index (PSSI). These tests include the Sonic Shear Test (ASTM D2603 and ASTM 5621), the Mechanical Shear Test (ASTM D6278), the Kurt Orbhan test, a FZG shear test and the KRL (Kugel Rollen Lager) or Tapered Roller Bearing (TRB) test codified as CEC L45-T-93.

Siloxanes are more resilient to permanent viscosity breakdown than competing hydrocarbons. In fact, polysiloxanes can exhibit a permanent shear threshold that is an "order of magnitude greater than that of organic polymers", which can be attributed to the high rotational freedom and bond strength of siloxanes. The shear stability of siloxanes may extend the service life of a siloxane based lubricant in comparison to hydrocarbon based lubricants that serve the same function.

The following specific embodiments are given to illustrate the design and use of polysiloxane base oils in lubricant compositions according to the teachings of the present disclosure and should not be construed to limit the scope of the disclosure. Those skilled-in-the-art, in light of the present disclosure, will appreciate that many changes can be made in the specific embodiments which are disclosed herein and still obtain alike or similar result without departing from or exceeding the spirit or scope of the disclosure.

Example 1—General Measurement Techniques

The physical and chemical properties exhibited by the lubricant compositions prepared according to the teachings of the present disclosure are measured using the equipment and test protocols or procedures described below and herein. One skilled in the art will understand that any properties reported herein represent properties that are routinely measured and can be obtained by multiple different methods. The methods described herein represent one such method and other methods may be utilized without exceeding the scope of the present disclosure.

Gel permeation chromatography (GPC) is used to obtain the molecular mass distributions of the polymer samples. The weight average molecular mass ($M_w$) can influence many polymer properties, such as viscosity. The siloxane branch content is determined using an INOVA 400/Mercury 400 NMR. The density (η) and kinematic viscosity (ν) are measured simultaneously over a temperature range of 303K to 398K in increments of 25K using a Cannon CT-2000 constant temperature bath with microprocessor control. The density is determined by precision measurements of the mass and volume of each sample. The kinematic viscosity is measured using Cannon-Fenske capillary viscometers. The absolute viscosity (η) is obtained from the kinematic viscosity and the density.

Figure 3:
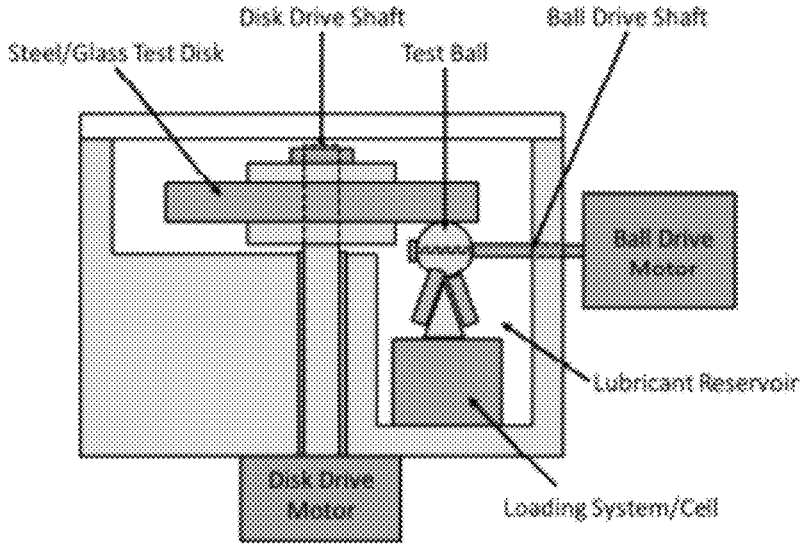
FIG. 3 is a cross-sectional depiction of an elastohydrodynamic (EHD) rig for use in film thickness and friction measurements.

Elastohydrodynamic lubrication (EHL) film thickness (h) is measured with a thin-film tribometer over a temperature range of 303 to 398 K using the instrument shown in FIG. 3. The temperature is held constant to +/−1 K for each test in the temperature sequence. The system uses a polished steel ball (AISI 52100, high carbon tool steel) of 19.050 mm diameter which is pressed against a transparent glass disk with a 500 nm thick silica spacer layer under a 20 N load. The assembly is able to measure ultrathin films with repeatability up to 1 nm for films under 30 nm and repeatability within 5% for films above 30 nm.

Still referring to FIG. 3, during the test, the ball is partly immersed in the fluid samples which allows for fluid transfer to the ball-disk interface. The disk rotation is varied in velocity increments of 40% to cover a velocity range of 0.020 m/s to 4.35 m/s at the radius chosen. Measurements of film thickness are undertaken in nominally pure rolling conditions with the ball allowed to rotate freely. Additional measurements are made on several fluids to determine if shear thinning occurs. In those tests, the ball is attached to a motor driven shaft and the slide to roll ratio (Σ), as defined in Equation 5, is varied from pure rolling (Σ=0) to pure sliding (Σ=2).

$$\Sigma = \frac{slidingspeed}{entrainmentspeed} = \frac{|U_1 - U_2|}{(U_1 + U_2)/2} \quad \text{Eq. (5)}$$

Measurements of friction coefficient (p) at different modes of lubrication are made with the friction testing capability of the same tribometer used to measure film thickness. Measurements are also made over a temperature range of 303 to 398 K under temperature controlled conditions held constant to +/−1 K for each test in the temperature sequence. The friction test is also undertaken using a steel ball (AISI 52100) of 19.050 mm diameter placed under load of 20 N in Hertzian contact with a steel disk. The ball is partly immersed in the fluid samples to allow fluid transfer to the ball-disk interface. The disk velocity is varied to achieve a velocity range 0.025 to 5.00 m/s at the radius chosen. The friction coefficient is measured at Σ=0.25, 0.50, 0.75 and 1.00 at each speed.

Boundary friction (μ) is measured at room temperature (303 K) using a CETR ball-on-disk tribometer. The friction test is undertaken using a steel ball (AISI 52100) of 9.50 mm diameter placed under load of 50 N in Hertzian contact with a steel disk. The steel ball (HRC~60) is harder than the steel disk (HRC~35) resulting in measurable wear on the disk. The ball is immersed in the fluid samples to allow fluid transfer to the ball-disk interface. The disk velocity is set to 0.05 m/s at the radius chosen to give an entrainment speed of 0.025 m/s at an effective slide to roll ratio of Σ=2.00.

Measurements of the wear scar depth and wear volume are made with an interferometry microscope with statistical distribution and wear profile integration capability. The boundary friction and wear measurements are repeated with high accuracy using multiple samples.

Four-Ball Wear Test—

Wearing properties or lubrication performance is evaluated according to the method defined in ASTM D-5183 (also known as standard test method DIN 51350-3 (Deutsches Insitut fur Normung E.V., Germany) entitled 'Testing of lubricants in the Shell four-ball tester'. The Shell Four Ball Tester (FBT) is a testing device used to determine welding and metal loads as well as different friction and wear characteristics of lubricants. The standard test consists of a rotating ball of a ball bearing being pressed onto three similar but immobile balls while applying a load of 100N and 400N for 1 hour test duration. Wear is determined by optically measuring the formed calotte (the worn depression area). This testing device is routinely used in the lubricant industry during product development and for quality control testing. The friction torque is recorded continuously and the wear scar reported as the average of the three steel balls in millimeters (mm).

SRV Wear Test—

The Load Carrying Capability (LCC) properties of the lubricant compositions are determined in accordance with ASTM D 5706-05 'Standard test method for determining extreme pressure properties of lubricating greases using a high-frequency, linear-oscillation (SRV) test machine'. The SRV test machine is used to determine load carrying and wear properties and coefficient of friction of lubricating greases at selected temperatures and loads specified for use in applications where high-speed vibrational or start-stop motions are present for extended periods of time under initial high Hertzian point contact pressures. This method has found application in qualifying lubricating greases used in constant velocity joints of front-wheel-drive automobiles and for lubricating greases used in roller bearings. This method is also be used for determining a fluid lubricant's ability to protect against wear and its coefficient of friction under similar test conditions.

In the following examples deviation from the standard test methodology in that a lubricating fluid is evaluated instead of lubrication greases; a steel cylinder is used instead of a steel ball; and the frequency is 10 Hz instead of 50 Hz. All measurements are carried out at 40° C. using 1 mm stroke. The load is increased in increments of 50 N every two minutes up to a maximum load of 2000 N.

Example 2—Preparation of Polysiloxane Base Oils

A commercially available alkylarylsiloxane (Xiameter® OFX-0203 Fluid, Dow Corning Corporation, Midland, Mich.) having a viscosity of 1,200 mPa-s (centipoise) at 25° C. is used as an example of a polysiloxane base oil having structure SW. This sample was stored as example # S(I)-1. A similar alkylarylsiloxane was obtained and stored as example # SW-2.

Examples of polysiloxane base oils having an aryl group attached to branched or linear alkyl functionality, similar to that shown as structure SOD, include PPMAS, such as poly(phenylhexylmethyl dimethyl)siloxane or poly(phenylhexylmethyl)siloxane. One method of synthesizing poly (phenylhexylmethyl dimethyl)siloxane is by the hydrosilation of 6-phenylhexene with poly(methylhydridedimethyl) siloxane using $(CpH)_2PtCl_2$ as the catalyst according to Equation 6. This reaction is undertaken with no solvent and takes approximately 4 hours to complete. The excess 6-phenylhexene is then isomerized and removed under static vacuum. The final product is filtered through silica-gel to remove the catalyst and stored until future use. Two samples of PPAMS are prepared that have a weight average molecular weight of 8.5 kg/mol and 29.9 kg/mol and stored as example #'s S(II)-1 having 30% hexylphenylmethyl D units and S(II)-2 having 100% hexylphenylmethyl D units, respectively.

Eq. (6)

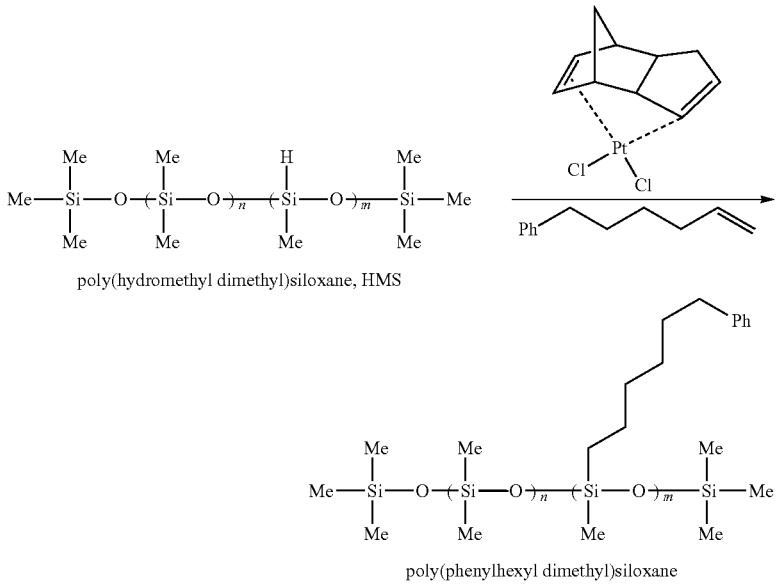

Several examples of conventional polysiloxane lubricants are obtained and stored for future use in comparing their lubricating properties against the properties exhibited by the polysiloxane base oils of the present disclosure. The conventional polysiloxane base oils include polydimethylsiloxane (PDMS) obtained as Dow Corning® 200 Fluid from Dow Corning Corporation, Midland, Mich. as different viscosity liquids. The viscosity of the Dow Corning® 200 Fluid obtained as conventional oil #'s C-1 to C-5 is stated to be about 10 $mm^2 \cdot s^{-1}$(cSt), 20 $mm^2 \cdot s^{-1}$(cSt), 50 $mm^2 \cdot s^{-1}$ (cSt), 100 $mm^2 \cdot s^{-1}$(cSt), 300 $mm^2 \cdot s^{-1}$(cSt), or 1000 $mm^2 \cdot s^{-1}$ (cSt). Another example of a conventional base oil is a liquid poly(alpha)olefin called Spectrasyn™ 6 from ExxonMobil Chemical Company, Houston, Tex. obtained and stored as Conventional oil #C-6.

Example 3—Characterization of Polysiloxane Base Oils and Use Thereof

The typical physical and chemical properties exhibited by the polysiloxane base oils labeled as example #'s S(I)-1 and S(I)-2 are summarized in Table 1 along with the properties of several conventional oils (Example #'s C-1 and C-6). Base oil example #'s S(I)-1 and SW-2 exhibit a viscosity at 40° C. greater than about 9 times that of conventional oils (C-1, C-6). Alternatively, the viscosity at 40° C. of the example #'s S(I)-1 and S(I)-2 is greater than about 1000 $mm^2 \cdot s^{-1}$ (cSt), alternatively greater than about 1200 $mm^2 \cdot s^{-1}$ (cSt).

TABLE 1

| | Description | Specific Gravity | Viscosity ($mm^2 \cdot s^{-1}$, 25° C.) |
|---|---|---|---|
| S(I)-1 | Dow Corning ® 203 | 0.912 | 1275 |
| S(I)-2 | Dow Corning ® 230 | 1.000-1.012 | 1125-1645 |

TABLE 1-continued

| | Description | Specific Gravity | Viscosity ($mm^2 \cdot s^{-1}$, 25° C.) |
|---|---|---|---|
| C-2 | Dow Corning ® 200 | 0.96 | 50 |
| C-6 | Spectrasyn ™ 6 | 0.827 | 138* |

*at 40° C.

The wear properties exhibited by polysiloxane base oil, S(I)-1 is compared against conventional PDMS and poly (alpha)olefin oils, C-2 and C-6, in Table 2. The wear scar that occurred on the ball used in the 4-ball test when exposed to S(I)-1 at a load of 400 N for 1 hour was observed to be less than that occurred when PDMS (C-2) or poly(alpha)olefin (C-6) were used. In addition, the conventional base oil (C−1) was observed to fail upon reaching a load between about 300-350 Newtons, while the polysiloxane base oil S(I)-1 did not fail until after at least a 550 Newton load was surpassed.

TABLE 2

| | SRV Load (N) | Wear Scar (mm) 100 N/1 hr | Wear Scar (mm) 400 N/1 hr |
|---|---|---|---|
| C-2 | 300 | 0.584 | load too high to measure |
| C-6 | 350 | 0.576 | 0.822 |
| S(I)-1 | 550 | x | 0.758 |
| S(II)-1 | 950 | x | x |

The typical physical and chemical properties (e.g., molecular mass, density, viscosity, percent group incorporation, group type, degree of polymerization [DP], and polydispersity [PD]) exhibited by the PPAMS base oils labeled as example #'s S(II)-1 and S(II)-2, as well as conventional PDMS base oils labeled as example #'s C-1, C-3, C-4, and C-5 are shown in Table 3. Primarily, example S(II)-2 exhibits about 100% incorporation of hexylphenylmethyl D units with the polysiloxane backbone and exhibits a molecular mass of approximately 30,000 g/mol, while example S(II)-1 incorporates about 30% of hexylphenylmethyl D units and exhibits a molecular mass of about 8,500 g/mol. In comparison the conventional PDMS oils (C-1, and C-3 to C-5) includes 100% incorporation of dimethyl groups with the polysiloxane backbone and exhibits a molecular mass ranging from about 1,750 g/mol (C−1) to about 32,000 g/mol (C-5).

aryl/alkyl content, a much greater polymer length (Z) or effective degree of polymerization (DP) is required.

Figure 4:
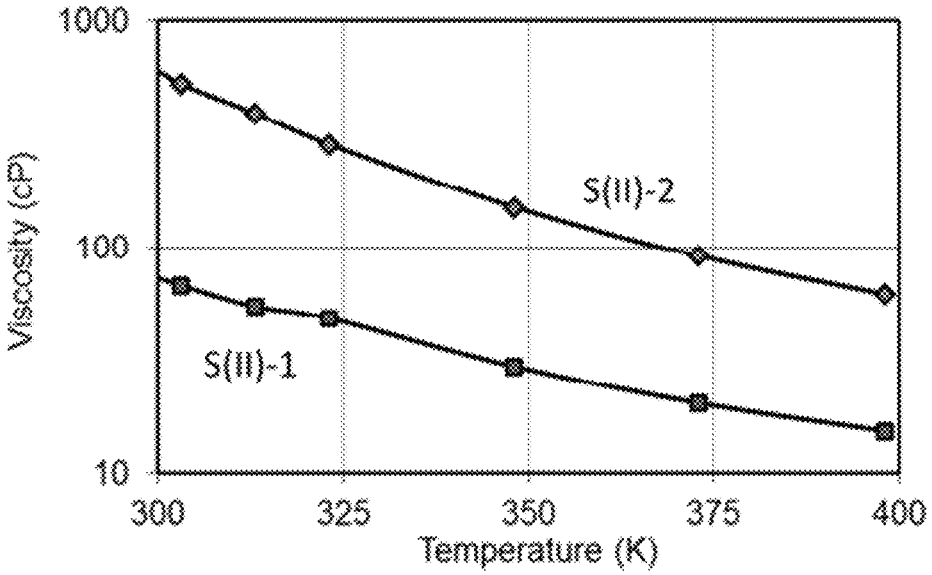
FIG. 4 is a graphical representation of viscosity exhibited by polysiloxane base oils prepared according to the teachings of the present disclosure plotted as a function of temperature.

The siloxane containing 30% hexylphenylmethyl units, S(II)-1, was clear-opaque after synthesis, while the siloxane containing 100% hexylphenylmethyl units, S(II)-2, was very sticky-tacky. The viscosity obtained for both S(II)-1 and S(II)-2 are plotted as a function of temperature in FIG. 4. The viscosity of S(II)-2 was unable to be measured by Cannon-Fenske viscometers, so its zero-shear viscosity (Table 3) was approximated from film formation data (see FIG. 6). Example S(II)-1 exhibits minor temporary shear thinning behavior at higher shear speeds, while S(II)-2 exhibits more severe shear thinning at most shear speeds. Siloxane-based lubricants may exhibit non-Newtonian behavior at high molecular masses and shear rates. Shear thinning is attributed to temporary alignment of the molecules and the higher molecular relaxation time associated with their greater molecular mass.

Figure 5:
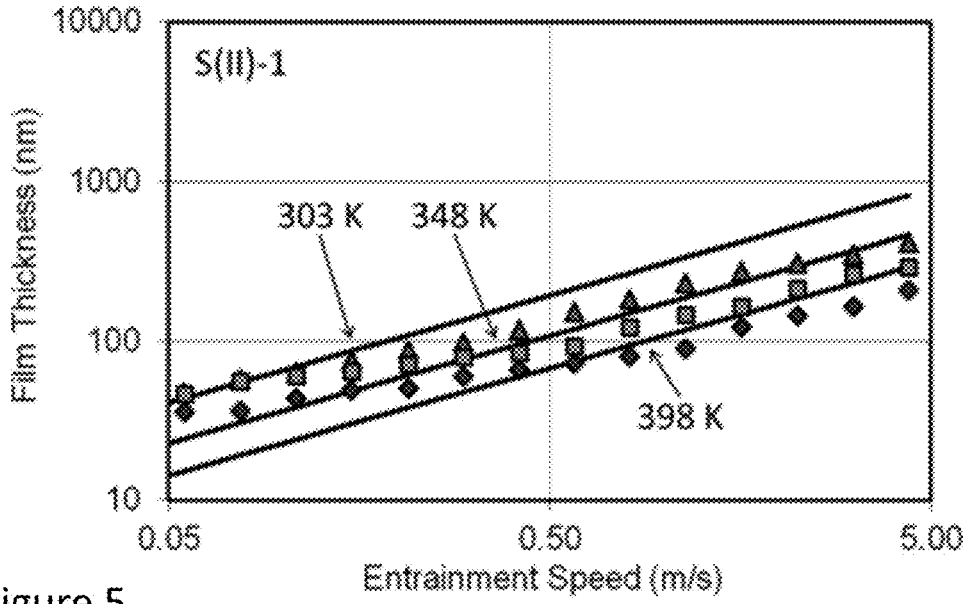
FIG. 5 is a graphical representation of elastohydrodynamic liquid (EHL) film thickness exhibited by a polysiloxane base oil plotted as a function of entrainment speed.
Figure 6:
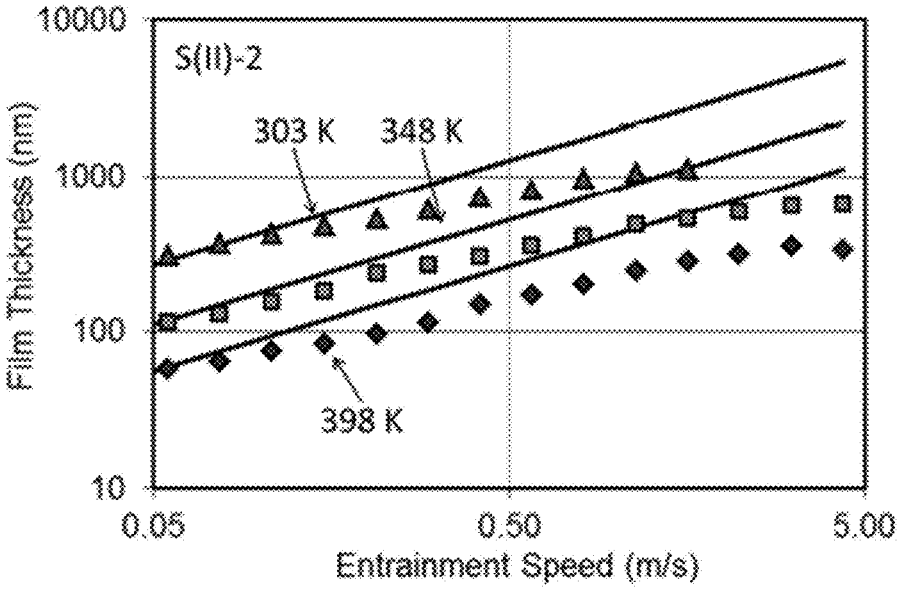
FIG. 6 is a graphical representation of elastohydrodynamic liquid (EHL) film thickness exhibited by another polysiloxane base oil plotted as a function of entrainment speed.

Measurements of film thickness against entrainment speed are shown on double logarithmic plots for the representative PPAMS examples, S(II)-1 and S(II)-2, in FIGS. 5 and 6, respectively. The film thickness at a given speed decreases with increasing temperature due to the decrease in the viscosity and the pressure-viscosity index. The film thicknesses predicted by the Hamrock-Dowson equations are plotted using the measured viscosity and interpolated pressure-viscosity (a*) at the same temperatures as the film formation measurements (Equation 1). The Hamrock-Dowson equation accurately predicts film thickness for lower molecular mass examples of PPAMS (FIG. 5) at low entrainment speeds. The viscosity of S(II)-2 could not be measured directly so the effective low shear viscosity of S(II)-2 is used for the calculated line in FIG. 6 and in Table 3. The discrepancy between measured and calculated film thickness may be attributed to temporary shear thinning phenomenon.

Figure 7:
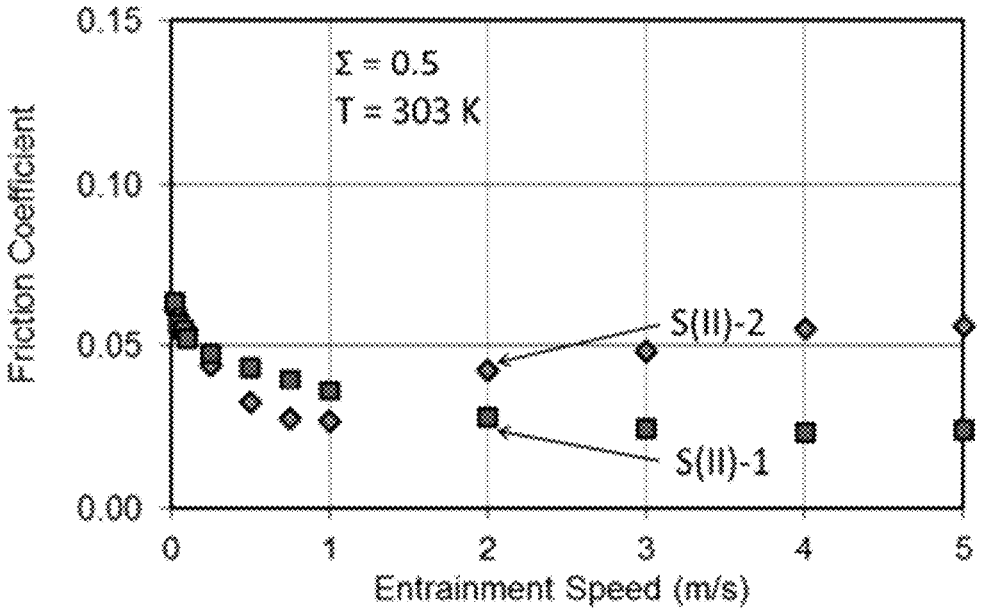
FIG. 7 is a graphical representation of friction coefficient exhibited by a polysiloxane base oil plotted as a function of entrainment speed.

The low EHD friction coefficient exhibited by examples S(II)-1 and S(II)-2 can be partially attributed to shear thinning behavior as evidenced by the film formation plots of FIG. 5. The friction coefficient of S(II)-2 is somewhat different than that exhibited by S(II)-1 in the room temperature (303 K) range as shown in FIG. 7. Although not wanting to be held to theory, the cause for the increase in friction for S(II)-2 at speeds above 1 m/s is believed to be its failure to

TABLE 3

| | Molecular Structure | | | Molecular Mass (g/mol) | | Density ($g/cm^3$) | | Viscosity ($mPa \cdot s$) | |
|---|---|---|---|---|---|---|---|---|---|
| | % D-unit | D-unit | DP | Mw | PD | at 303 K | at 398 K | at 303 K | at 398 K |
| S(II)-1 | 30 | hexylphenyl | 37 | 8,510 | 1.83 | 1.01 | 0.94 | 68 | 16 |
| S(II)-2 | 100 | hexylphenyl | 46 | 29,900 | 2.67 | 0.97 | 0.9 | 800 | 150 |
| C-1 | 100 | dimethyl | 18 | 1,760 | 1.19 | 0.88 | 0.81 | 8 | 7 |
| C-3 | 100 | dimethyl | 87 | 9,930 | 1.51 | 0.94 | 0.87 | 102 | 86 |
| C-4 | 100 | dimethyl | 135 | 19,900 | 1.95 | 0.95 | 0.87 | 262 | 218 |
| C-5 | 100 | dimethyl | 222 | 32,000 | 1.93 | 0.96 | 0.88 | 937 | 781 |

The density and viscosity of the polysiloxane base oils, S(II)-1 and S(II)-2 at 303K (30° C.) and at 398K (125° C.) are observed to be lower than the density and viscosity of the conventional PDMS oil (see C-3 and C-5) having a similar molecular mass. The density generally increases with molecular mass for polymers of similar molecular structure. Polymer viscosity increases with polymer length, branch content and branch length. For a siloxane with low aryl/alkyl content to attain the same viscosity as a siloxane with high form a full film. This failure is attributed to a high molecular relaxation time for S(II)-2. The high molecular relaxation time of S(II)-2 prevents it from quickly returning to bulk conditions after the pin/ball passes any point on the disk. As velocity increases, the time (A) that a fluid takes to pass through the ball/disk interface decreases. When the time of transit falls below the molecular relaxation time ($\lambda < \lambda_{EB}$), shear thinning sets in and a full film cannot be maintained.

The film failure allows the metal asperities of the ball and disk to come into contact giving a higher friction coefficient as shown in FIG. 7.

Figure 8:
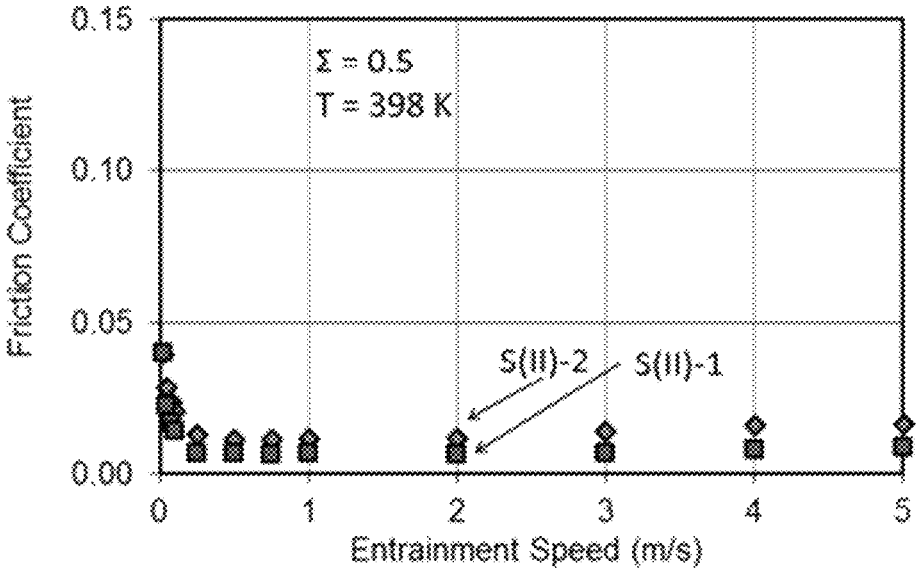
FIG. 8 is a graphical representation of friction coefficient exhibited by a polysiloxane base oil plotted as a function of entrainment speed at another temperature.

As temperature increases, the molecular relaxation time decreases and the film separated by the moving ball is able to properly reform within a revolution of the disk. The friction measurements of S(II)-2 at 398K show that the temporary shear thinning that caused a film failure at 303K is no longer as severe (FIG. 8). At high temperatures, the decreased molecular relaxation time of S(II)-2 allows it to perform similar to S(II)-1.

Boundary friction and wear resistance tests conducted at 303K, as well as the configuration associated with the ball on disk test allows one skilled in the art to see the path made by the ball as it passes through the lubricant. The boundary friction and wear observed for Examples S(II)-1 and S(II)-2 are summarized FIG. 9. Although, Example S(II)-2 did not perform as well as Example S(II)-1 with respect to both boundary friction and wear, both examples exhibited boundary friction less than about 0.30 and total wear less than about 3.0 $mm^3$; alternatively, boundary friction less than about 0.05 and wear less than about 0.15 $mm^3$ as shown for S(II)-1.

Figure 10:
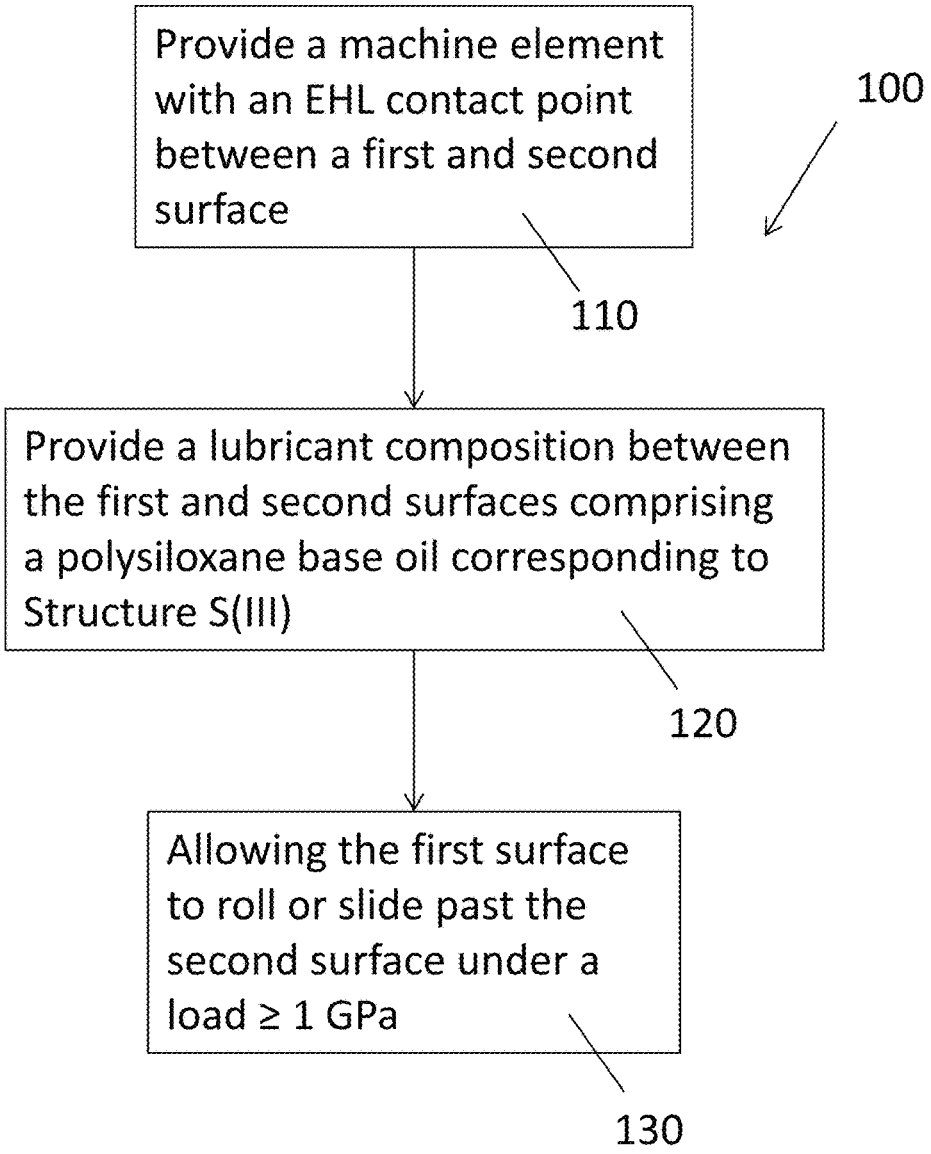
FIG. 10 is a schematic representation of a method of using a lubricant composition comprising a polysiloxane base oil to reduce wear between surfaces placed under a high load condition.

According to another aspect of the present disclosure, a method of reducing wear between rolling or sliding surfaces in a machine element is provided. Referring now to FIG. 10, the method 100 generally comprises the steps of providing a machine element 110 having a first and second surface; providing a lubricant composition 120 between the first and second surfaces; and allowing the first surface to roll or slide past the second surface 130 under a load condition in excess of 1 GPa. In this method, the two surfaces are "hard" surfaces and represent an elastohydrodynamic lubrication (EHL) contact point in the machine element. Alternatively, the first and second surfaces are ceramic or metal surfaces; alternatively, the two surfaces are metal surfaces. The machine element may include, but not be limited to, a rolling element bearing, a sliding bearing, a gear, a cam and cam follower, or a traction drive.

The lubricant composition used in this method 100 may include any of the polysiloxane base oils described herein corresponding to Structure S(III) as previously described herein; alternatively, the polysiloxane base oils correspond to either Structure S(I) or SOD as previously described herein. Optionally, the lubricant composition may further comprise at least one functional additive to impart or improve certain properties exhibited by the lubricant composition. Such functional additive(s) are selected as one from the group of friction modifiers, anti-wear additives, extreme pressure additives, seal swelling agents, rust and corrosion inhibitors, thickeners, Viscosity Index improvers, pour point depressants, anti-oxidants, free-radical scavengers, hydroperoxide decomposers, metal passivators, surface active agents such as detergents, emulsifiers, demulsifiers, defoamants, compatibilizers, dispersants, and mixtures thereof that are known to one skilled in the art. Further additives that may be incorporated into the lubricant composition without exceeding the scope of the present disclosure include, but are not limited to, deposit control additives, film forming additives, tackifiers, antimicrobials, additives for biodegradable lubricants, haze inhibitors, chromophores, and limited slip additives.

Several specific examples of friction modifiers that can be used as a functional additive in the lubricant composition include long-chain fatty acids and their derivatives, molybdenum compounds, aliphatic amines or ethoxylated aliphatic amines, ether amines, alkoxylated ether amines, acylated amines, tertiary amines, aliphatic fatty acid amides, aliphatic carboxylic acids, aliphatic carboxylic esters, polyol esters, aliphatic carboxylic ester-amides, imidazolines, aliphatic phosphonates, aliphatic phosphates, aliphatic thiophosphonates, and aliphatic thiophosphates, among others or mixtures thereof.

Several specific examples of anti-wear additives and extreme pressure additives that can be used a functional additive to the lubricant composition include, but are not limited to, organosulfur and organo-phosphorus compounds, such as organic polysulfides among which alkylpolysulfides; phosphates among which trihydrocarbyl phosphate, dibutyl hydrogen phosphate, amine salt of sulfurized dibutyl hydrogen phosphate, dithiophosphates; dithiocarbamates dihydrocarbyl phosphate; sulfurized olefins, such as sulfurized isobutylene, and sulfurized fatty acid esters or mixtures thereof.

Several specific examples of seal swell agents that can be used as a functional additive in the lubricant composition include esters, adipates, sebacates, azeealates, phthalates, sulfones such as 3-alkoxytetraalkylene sulfone, substituted sulfolanes, aliphatic alcohols of 8 to 13 carbon atoms such as tridecyl alcohol, alkylbenzenes, aromatics, naphthalene depleted aromatic compounds, and mineral oils, among others or mixtures thereof.

Several specific examples of rust and corrosion inhibitors that can be used a functional additive to the lubricant composition include, but are not limited to, monocarboxylic acids such as octanoic acid, decanoic acid and dodecanoic acid; polycarboxylic acids such as dimer and trimer acids from tall oil fatty acids, oleic acid, linoleic acid; thiazoles; triazoles such as benzotriazole, decyltriazole, 2-mercapto benzothiazole; thiadiazoles such as 2,5-dimercapto-1,3,4-thiadiazole, 2-mercapto-5-hydrocarbyldithio-1,3,4-thiadiazole; metal dithiophosphates; ether amines; acid phosphates; amines; polyethoxylated compounds such as ethoxylated amines; ethoxylated phenols; ethoxylated alcohols; imidazolines; and aminosuccinic acids or mixtures thereof.

Several specific examples of thickeners that can be used as a functional additive to the lubricant composition include metallic soaps, such as lithium soaps; silica, expanded graphite; polyuria; and clays, such as hectorite or bentonite; among others or mixtures thereof. In some instances, when thickened, the lubricant composition may become a grease composition.

Several specific examples of Viscosity Index improvers that can be used a functional additive to the lubricant composition include, but are not limited to, polymethacrylates, olefin copolymers, polyisoalkylene such as polyisobutylene, styrene-diene copolymers, and styrene-ester copolymers, such as styrenemaleic ester; or mixtures thereof.

Several specific examples of pour point depressants include, but are not limited to, wax-alkylated naphthalenes and phenols, polymethacrylates, and styrene-ester copolymers or mixtures thereof.

Several specific examples of anti-oxidants include, but are not limited to, phenolic antioxidants such as 2,6-di-tert-butylphenol, tertiary butylated phenols such as 2,6-di-tert-butyl-4-methylphenol, 4,4'-methylenebis(2,6-di-tert-butylphenol), 2,2'-methylene-bis(4-methyl6-ter t-butylphenol), 4,4'-thiobis(2-methyl-6-tert-butylphenol); mixed methylene-bridged polyalkyl phenols; aromatic amine antioxidants; sulfurized phenolic antioxidants; organic phosphites; amine derivatives such as p-, p'-dioctyldiphenylamine, N,N'-di-sec-butylphenylenediamine, 4-isopropylaminodiphenylamine, phenyl-.alpha.-naphthyl amine, ring-alkylated diphenylamines; bisphenols; and cinnamic acid derivatives, or mixtures thereof.

Several specific examples of free-radical scavengers and hydroperoxide decomposers that can be used a functional additive to the lubricant composition include, but are not limited to, include zinc dialkyl dithiophosphates, hindered phenols, or alkylated arylamines; and organo-sulfur compounds or organo-phosphorus compounds, respectively. Several specific examples of metal passivators include, but are not limited to, poly-functional (polydentate) compounds, such as ethylenediaminetetraacetic acid (EDTA) and salicylaldoxime, or mixtures thereof. Several specific examples of defoamants include, but are not limited to, polysiloxanes, polyacrylates and styrene ester polymers, or mixtures thereof.

Several specific examples of surface active agents such as detergents, dispersants, emulsifiers, demulsifiers, that can be used as a functional additive in the lubricant composition, include, but are not limited to, alkali metal or alkaline earth metal salts of organic acids such as magnesium sulfonate, zinc sulfonate, magnesium phenate, zinc phenate, lithium sulfonate, lithium carboxylate, lithium salicylate, lithium phenate, sulfurized lithium phenate, magnesium sulfonate, magnesium carboxylate, magnesium salicylate, magnesium phenate, sulfurized magnesium phenate, potassium sulfonate, potassium carboxylate, potassium salicylate, potassium phenate, sulfurized potassium phenate; common acids such as alkylbenzenesulfonic acids, alkylphenols, fatty carboxylic acids, polyamine, and polyhydric alcohol derived polyisobutylene derivatives, or mixtures thereof.

Figure 9:
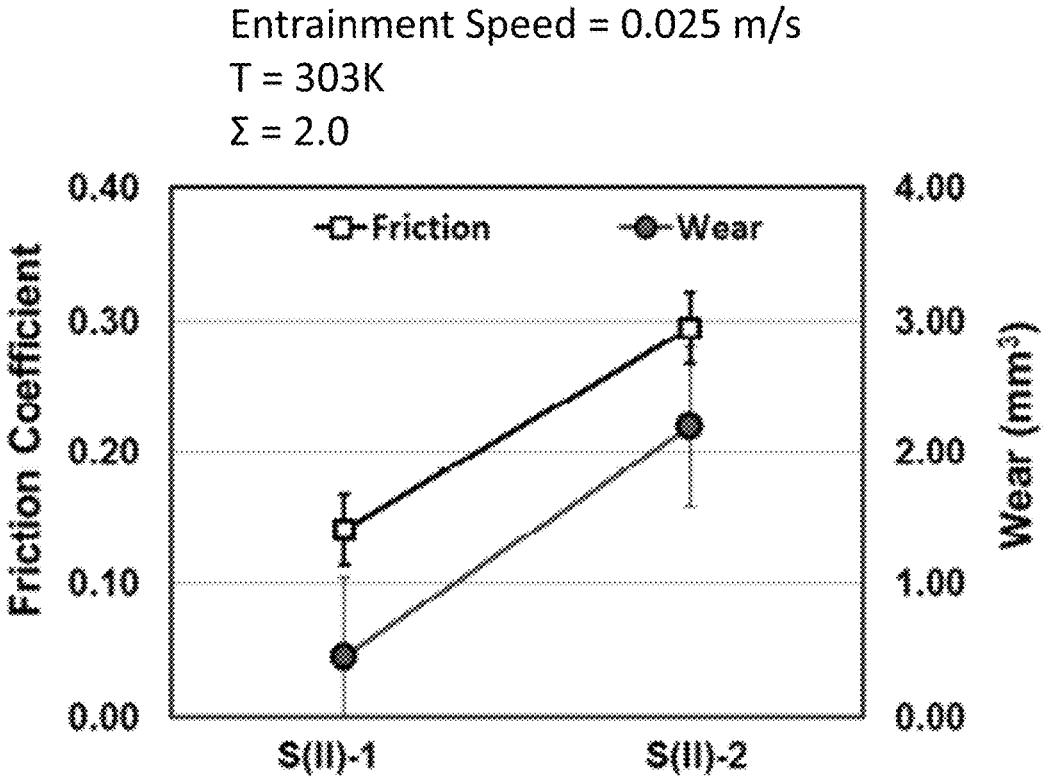
FIG. 9 is a comparison of the friction and total wear observed for the use of different polysiloxane base oils prepared according to the teachings of the present disclosure.

The lubricant composition when used according to the method 100 provides an EHL film thickness between 10 and 2,000 nm at a temperature of 303K and an entrainment speed between 0.05 and 5.00 m/s. At a temperature of 398K the EHL film thickness of the lubricant composition ranges from about 10 to about 1,000 nm at an entrainment speed between 0.05 and 5.00 m/s. The lubricant composition also exhibits a coefficient of friction that is less than about 0.07 at a temperature of 303 K, a Hertzian pressure of about 0.8 GPa, and an entrainment speed between 0.05 and 5.00 m/s (FIG. 7). The lubricant composition also exhibits a coefficient of friction that is less than about 0.06 at a temperature of 398 K, a Hertzian pressure of about 0.8 GPa, and an entrainment speed between 0.05 and 5.00 m/s (FIG. 8). The lubricant composition also exhibits a coefficient of friction that is less than about 0.15 at a temperature of 303 K, a Hertzian pressure of about 1.8 GPa, and an entrainment speed of 0.025 m/s (FIG. 9).

The foregoing description of various forms of the invention has been presented for purposes of illustration and description. It is not intended to be exhaustive or to limit the invention to the precise forms disclosed. Numerous modifications or variations are possible in light of the above teachings. The forms discussed were chosen and described to provide the best illustration of the principles of the invention and its practical application to thereby enable one of ordinary skill in the art to utilize the invention in various forms and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A method of reducing wear between two surfaces placed under a load condition in excess of 1 GPa, said method comprising providing a lubricant composition between the two surfaces, the lubricant composition comprising a polysiloxane base oil corresponding to the structural formula:

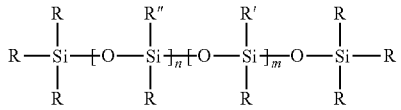

wherein each R, R', and R" is independently selected, such that R is an alkyl group having between 1-3 carbon atoms; R' is an alkylaryl group comprising alkyl functionality with 3-12 carbon atoms and aryl functionality with 6 to 12 carbon atoms; R" is an alkyl group having between 1-12 carbon atoms or an alkylaryl group comprising alkyl functionality with 2-12 carbon atoms and aryl functionality with 6 to 12 carbon atoms; m is an integer, and n is an integer or 0, with the proviso that 8<(m+n)<500.

2. The method according to claim 1, wherein the R in the polysiloxane base oil is a methyl group, the R' is an alkylphenyl group with the alkyl functionality having between 5-8 carbon atoms; and the R" is a methyl group or an alkylphenyl group with the alkyl functionality having between 2-5 carbon atoms.

3. The method according to claim 1, wherein the polysiloxane base oil corresponds to the structural formula:

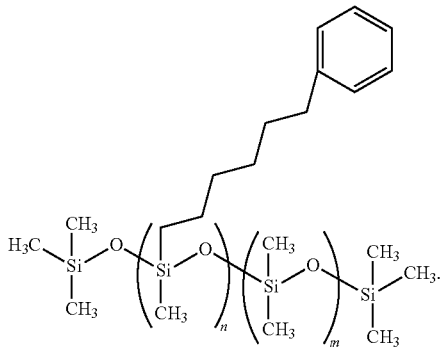

4. The method according to claim 1, wherein the polysiloxane base oil corresponds to the structural formula:

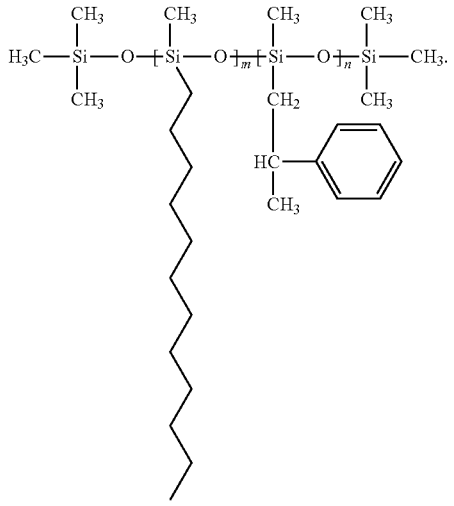

5. The method according to claim 1, wherein the integers m and n in the structure of the polysiloxane base oil are selected such that the sum of (m+n) is greater than 8 and less than 250 and optionally, the ratio of the integer m to the sum of the integers (m+n) in the polysiloxane base oil is between 0.1 and 1.00.

6. The method according to claim 1, wherein the polysiloxane base oil exhibits at least one of the following, a molecular mass between 1,500 g/mol and 35,000 g/mol or a viscosity at zero shear and 303 K between 50 and 5,000 mPa-sec.

7. The method according to claim 1, wherein the lubricant composition further comprises at least one functional additive selected as one from the group of extreme pressure additives, anti-wear additives, antioxidants, antifoams, and corrosion inhibitors.

8. The method according to claim 1, wherein the two surfaces represent an elastohydrodynamic lubrication (EHL) contact point in a machine element.

9. The method according to claim 8, wherein the machine element is a rolling element bearing, a plane bearing, a sliding bearing, a gear, a cam and a cam follower, or a traction drive; and optionally, the two surfaces are metal surfaces.

10. The method according to claim 1, wherein the lubricant composition provides one or more of the following, an EHL film thickness on the surface between 10 and 2,000 nm at a temperature of 303 K and an entrainment speed between 0.05 and 5.00 m/s or an EHL film thickness on the surface between 10 and 1,000 nm at a temperature of 398 K and an entrainment speed between 0.05 and 5.00 m/s.

11. The method according to claim 10, wherein the lubricant composition provides one or more of the following, a coefficient of friction less than 0.07 at a temperature of 303 K and an entrainment speed between 0.05 and 5.00 m/s or a coefficient of friction less than 0.05 at a temperature of 398 K and an entrainment speed between 0.05 and 5.00 m/s.

12. A method of reducing wear between rolling or sliding surfaces in a machine element, the method comprising the steps of:

providing a machine element having a first surface and a second surface; the first and second surfaces representing an elastohydrodynamic lubrication (EHL) contact point in the machine element;

providing a lubricant composition between the first surface and second surface, the lubricant composition comprising:

a polysiloxane base oil corresponding to the structural formula:

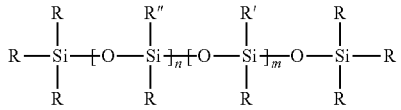

in which each R, R', and R" is independently selected, such that R is an alkyl group having between 1-3 carbon atoms; R' is an alkylaryl group comprising alkyl functionality with 3-12 carbon atoms and aryl functionality with 6 to 12 carbon atoms; R" is an alkyl group having between 1-12 carbon atoms or an alkylaryl group comprising alkyl functionality with 2-12 carbon atoms and aryl functionality with 6 to 12 carbon atoms; m is an integer, and n is an integer or 0, with the proviso that 8<(m+n)<500; and allowing the first surface to roll or slide past the second surface under a load condition in excess of 1 GPa.

13. The method according to claim 12, wherein the R in the polysiloxane base oil is a methyl group, the R' is an alkylphenyl group with the alkyl functionality having between 5-8 carbon atoms; and the R" is a methyl group or an alkylphenyl group with the alkyl functionality having between 2-5 carbon atoms.

14. The method according to claim 12, wherein the polysiloxane base oil corresponds to the structural formula:

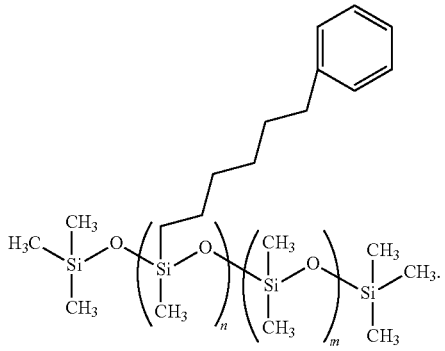

15. The method according to claim 12, wherein the polysiloxane base oil corresponds to the structural formula:

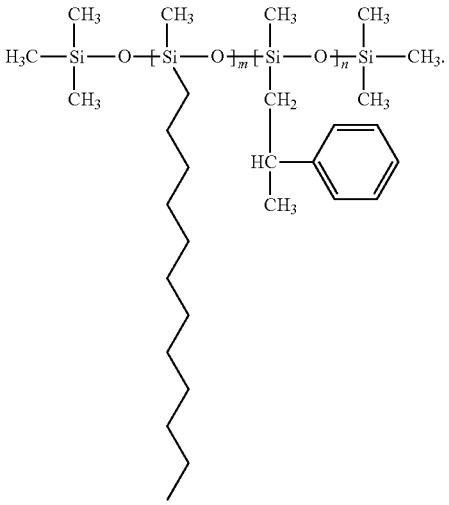

16. The method according to claim 12, wherein the integers m and n in the structure of the polysiloxane base oil are selected such that the sum of (m+n) is greater than 8 and less than 250 and the ratio of the integer m to the sum of (m+n) is between 0.5 and 1.00.

17. The method according to claim 12, wherein the machine element is a rolling element bearing, a sliding bearing, a gear, a cam and a cam follower, or a traction drive, and optionally, with the first and second surfaces being metal surfaces.

18. The method according to claim 12, wherein the lubricant composition provides an EHL film thickness between the first surface and the second surface that is between 90 and 900 nm at a temperature of 303 K and between 20 and 200 nm at a temperature of 398 K at an entrainment speed between 0.05 and 5.00 m/s.

19. The method according to claim 18, wherein the lubricant composition provides a coefficient of friction less than 0.07 at a temperature of 303 K and less than 0.05 at a temperature of 398 K at an entrainment speed between 0.05 and 5.00 m/s.

* * * * *